US009379436B1

(12) United States Patent
Yu

(10) Patent No.: US 9,379,436 B1
(45) Date of Patent: Jun. 28, 2016

(54) COMPENSATING FOR BIT TOGGLE ERROR IN PHASE SHIFTERS

(71) Applicant: The Boeing Company, Chicago, IL (US)

(72) Inventor: Kai-Bor Yu, Lake Forest, CA (US)

(73) Assignee: THE BOEING COMPANY, Chicago, IL (US)

( * ) Notice: Subject to any disclaimer, the term of this patent is extended or adjusted under 35 U.S.C. 154(b) by 533 days.

(21) Appl. No.: 13/901,885

(22) Filed: May 24, 2013

(51) Int. Cl.
*H01Q 3/02* (2006.01)
*H01Q 3/24* (2006.01)

(52) U.S. Cl.
CPC ..... *H01Q 3/24* (2013.01)

(58) Field of Classification Search
CPC ..... H01Q 3/02; H01Q 3/12; H01Q 3/22; H01Q 3/24; H01H 1/029
USPC ..... 342/374
See application file for complete search history.

(56) References Cited

U.S. PATENT DOCUMENTS 5,103,232 A * 4/1992 Chang ..... H01Q 3/38 342/372
6,285,783 B1 * 9/2001 Isomura ..... G06T 7/0002 382/140
6,463,266 B1 * 10/2002 Shohara ..... H03J 7/04 375/219
6,777,771 B1 * 8/2004 Marumoto ..... H01Q 1/36 257/500
7,205,937 B2 4/2007 Hein
7,602,337 B2 * 10/2009 Choi ..... H01Q 3/385 342/375
8,749,280 B2 * 6/2014 Lin ..... H03L 7/081 327/107
2003/0117315 A1 * 6/2003 Graham ..... G01R 29/10 342/174
2005/0242993 A1 * 11/2005 Hein ..... H01Q 3/22 342/375
2008/0231375 A1 * 9/2008 Welz ..... H03L 7/181 331/17

FOREIGN PATENT DOCUMENTS

JP 02152306 A * 6/1990

OTHER PUBLICATIONS

Romanofsky, "Array Phase Shifters: Theory and Technology," National Aeronautics and Space Administration, NASA/TM-2007-214906, Oct. 2007, 29 pages.

* cited by examiner

*Primary Examiner* — Harry Liu
(74) *Attorney, Agent, or Firm* — Yee & Associates, P.C.

(57) ABSTRACT

A method for electronically compensating for quantization errors and bit toggle errors with phase shifters. A new bit state for a phase shifter associated with an element is identified based on a desired phase shift for the element. The new bit state minimizes a quantization error and a bit toggle error between the desired phase shift for the element and an actual phase shift that results when a current bit state is switched to the new bit state. A command is sent to the phase shifter to switch from the current bit state to the new bit state.

20 Claims, 5 Drawing Sheets

200

202 204 206

| BIT STATES | EXPECTED PHASE SHIFTS | ACTUAL PHASE SHIFTS |
|---|---|---|
| 0000 | 0.0 | 2.5 |
| 0001 | 22.5 | 20.2 |
| 0010 | 45.0 | 49.0 |
| 0011 | 67.5 | 52.6 |
| 0100 | 90.0 | 87.0 |
| 0101 | 112.5 | 109.4 |
| 0110 | 135.0 | 130.0 |
| 0111 | 157.5 | 155.9 |
| 1000 | 180.0 | 184.3 |
| 1001 | 202.5 | 200.0 |
| 1010 | 225.0 | 231.5 |
| 1011 | 247.5 | 246.8 |
| 1100 | 270.0 | 264.7 |
| 1101 | 292.5 | 294.6 |
| 1110 | 315.0 | 317.0 |
| 1111 | 337.5 | 342.7 |

FIG. 2

COMPENSATING FOR BIT TOGGLE ERROR IN PHASE SHIFTERS

BACKGROUND INFORMATION

1. Field

The present disclosure relates generally to phased array antennas, and in particular, to phase shifters used with phased array antenna. Still more particularly, the present disclosure relates to a method and apparatus for electronically compensating for bit toggle errors associated with n-bit phase shifters to improve beam steering accuracy.

2. Background

As used herein, a "phased array antenna" is an array of antenna elements that may be used to direct a beam of electromagnetic radiation in a particular angular direction relative to the array of antenna elements. The array of antenna elements may include, for example, hundreds, thousands, or some other number of antenna elements arranged in an array. Each of these antenna elements may be capable of converting an electrical signal into electromagnetic radiation and/or converting electromagnetic radiation into an electrical signal.

The beam of electromagnetic radiation formed by an array of antenna elements may be directed, or steered, by controlling the phases applied to the electrical signals received and/or formed by the array of antenna elements. Typically, these phases are controlled using phase shifters. With currently available phased array antennas, digital phase shifters are most commonly used. A digital phase shifter provides a discrete set of phase states. Each phase state may correspond to a phase shift that may be applied to an electrical signal. The phase shift may be any phase angle between about 0 degrees and about 360 degrees. The set of phase states provided may be controlled by a group of bits. Each bit may be toggled between a bit value of "0" and a bit value of "1." The bit values for the different phase bits may together form a binary configuration for the phase shifter. Each possible binary configuration may correspond to a particular phase state. In this manner, the number of possible phase states may be determined by the number of bits. With n bits, $2^n$ phase states may be provided.

When electronically steering the beam of electromagnetic radiation formed by an array of antenna elements, each phase shifter associated with an antenna element may be commanded to switch to a particular binary configuration to achieve a desired phase shift. However, the resulting phase shift may be different from the desired phase shift. This resulting phase shift may include a quantization error and a bit toggle error.

For example, the desired phase shift for a particular antenna element may fall between two discrete phase states. The difference between the desired phase shift and the phase shift indicated by the closest of the two phase states may be referred to as the quantization error. Further, toggling one or more bits for the phase shifter to change the binary configuration for the phase shifter between bit values may also introduce an error, which may be referred to as the bit toggle error.

The quantization errors and bit toggle errors associated with the phase shifters of a phased array antenna may reduce the accuracy with which the beam of electromagnetic radiation may be steered. Therefore, it would be advantageous to have a method and apparatus that take into account at least some of the issues discussed above, as well as other possible issues.

SUMMARY

In one illustrative example, an apparatus comprises a phase shifter and a controller. The phase shifter is configured to provide a phase shift to an element by switching between a set of bit states that correspond to a discrete set of phase shifts. The controller is configured to identify a new bit state for the phase shifter based on a desired phase shift for the element. The new bit state minimizes a quantization error and a bit toggle error between the desired phase shift for the element and an actual phase shift that results when a current bit state is switched to the new bit state.

In another illustrative example, an antenna system comprises an array of elements, a plurality of phase shifters associated with the array of elements, and a controller. A phase shifter in the plurality of phase shifters is configured to apply a phase shift to an element in the array of elements by switching between a set of bit states that correspond to a discrete set of phase shifts. The controller is configured to identify a new bit state for the phase shifter based on a desired phase shift for the element. The controller is further configured to command the phase shifter to switch from a current bit state to the new bit state. The new bit state minimizes a quantization error and a bit toggle error between the desired phase shift for the element and an actual phase shift that results when the current bit state is switched to the new bit state.

In yet another illustrative example, a method is provided. A new bit state for a phase shifter associated with an element is identified based on a desired phase shift for the element. The new bit state minimizes a quantization error and a bit toggle error between the desired phase shift for the element and an actual phase shift that results when a current bit state is switched to the new bit state. A command is sent to the phase shifter to switch from the current bit state to the new bit state.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

FIG. 2 is an illustration of a table of bit states, expected phase shifts, and actual phase shifts in accordance with an illustrative embodiment;

DETAILED DESCRIPTION

The illustrative embodiments recognize and take into account different considerations. For example, the illustrative embodiments recognize and take into account that it may be desirable to have a phased array antenna capable of electronically compensating for both quantization errors and bit toggle errors. In particular, the illustrative embodiments recognize and take into account that it may be desirable to have a method for electronically compensating for bit toggle errors that does not require any additional hardware and/or other types of devices. In this manner, the weight of the phased array antenna may not be increased more than desired.

Figure 1:
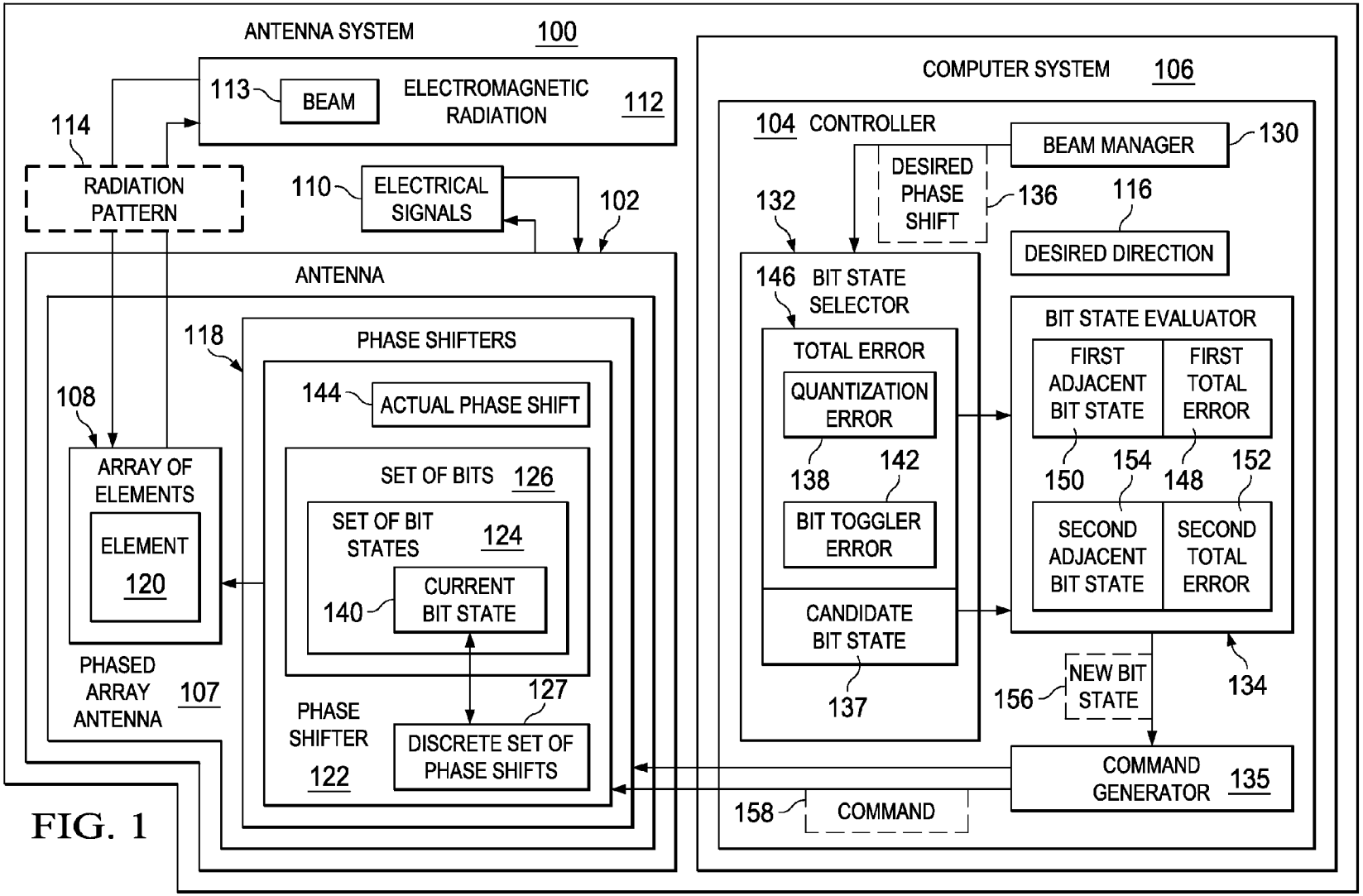
FIG. 1 is an illustration of an antenna system in the form of a block diagram in accordance with an illustrative embodiment.

Referring now to the figures and, in particular, with reference to FIG. 1, an illustration of an antenna system in the form of a block diagram is depicted in accordance with an illustrative embodiment. In these illustrative examples, the antenna system 100 includes an antenna 102 and a controller 104.

The controller 104 may be implemented using hardware, software, or a combination of the two. In these illustrative examples, the controller 104 may be implemented in a computer system 106. The computer system 106 may include a number of computers. As used herein, a "number of" items means one or more items. For example, a number of computers means one or more computers. When more than one computer is present in the computer system 106, these computers may be in communication with each other.

In these illustrative examples, the controller 104 may be in communication with the antenna 102. In particular, the controller 104 may be electrically connected to the antenna 102 in these depicted examples. As used herein, when a first component, such as the controller 104, is electrically connected to a second component, such as the antenna 102, the first component is connected to the second component such that an electrical signal can be sent from the first component to the second component, the second component to the first component, or a combination of the two.

Further, the first component may be electrically connected to the second component without any additional components between the two components. The first component also may be electrically connected to the second component by one or more other components. For example, one electronic device may be electrically connected to a second electronic device without any additional electronic devices between the first electronic device and the second electronic device. In some cases, another electronic device may be present between the two electronic devices electrically connected to each other.

In other illustrative examples, the controller 104 may be in a location remote to the antenna 102. As one illustrative example, the controller 104 may be configured to communicate with the antenna 102 using wireless communications links, optical links, and/or some other suitable type of communications links.

The antenna 102 may be implemented in the form of a phased array antenna 107. The phased array antenna 107 may include an array of elements 108. The array of elements 108 may take the form of, for example, a one-dimensional array or a two-dimensional array. The elements in the array of elements 108 also may be referred to as antenna elements.

In these illustrative examples, the array of elements 108 may be configured to transmit and/or receive electromagnetic radiation 112. For example, the array of elements 108 may be configured to receive and convert electrical signals 110 into the electromagnetic radiation 112 that is then transmitted. Additionally or alternatively, the array of elements 108 may be configured to receive and convert the electromagnetic radiation 112 into the electrical signals 110.

The antenna 102 may transmit and/or receive the electromagnetic radiation 112 in the form of a beam 113. The beam may produce a radiation pattern 114. The controller 104 is configured to manage the antenna 102 such that the radiation pattern 114 produced is a desired radiation pattern. When the antenna 102 transmits the electromagnetic radiation 112, the radiation pattern 114 of the antenna 102 describes the relative strength of the electromagnetic radiation 112 transmitted in the various directions with respect to the antenna 102. When the antenna 102 receives the electromagnetic radiation 112, the radiation pattern 114 of the antenna 102 describes the relative sensitivity of the antenna 102 to the electromagnetic radiation 112 received from the various directions with respect to the antenna 102.

The radiation pattern 114 produced when the antenna 102 is transmitting the electromagnetic radiation 112 may or may not be the same as the radiation pattern 114 produced when the antenna 102 is receiving the electromagnetic radiation 112, depending on the implementation. The radiation pattern 114 for the antenna 102 also may be referred to as an antenna pattern and a far-field pattern.

The antenna 102 may be electronically steered in a desired direction 116 with respect to the antenna 102 such that the beam 113 formed by the antenna 102 is directed in the desired direction 116. This desired direction 116 may be a desired angular direction. The desired direction 116 in which the antenna 102 has been electronically steered may be indicated by the main lobe, or largest lobe, in the radiation pattern 114.

Electronically steering the antenna 102 in the desired direction 116 may include changing the phases of the array of elements 108. The phase of a particular element may be the phase applied to the electrical signals 110 received or generated by the element. For example, the phases applied to the electrical signals 110 received at the array of elements 108 may be varied such that the electromagnetic radiation 112 transmitted by the antenna 102 is strongest in a particular direction. Similarly, the phases for the electrical signals 110 generated by the array of elements 108 in response to receiving the electromagnetic radiation 112 may be varied such that the array of elements 108 is most sensitive to the electromagnetic radiation 112 received from a particular direction.

In this illustrative example, electronic steering of the antenna 102 may be performed using a plurality of phase shifters 118 associated with the array of elements 108. In particular, the phase shifters 118 may be electrically connected to the array of elements 108. More specifically, each of the phase shifters 118 may be electrically connected to a corresponding element in the array of elements 108.

For example, one phase shifter 122 may be electrically connected to an element 120 in the array of elements 108. The phase shifter 122 may be used to apply a phase, or phase shift, to the electrical signals received at and/or generated by the element 120. The phase that is applied may be determined by the bit state of a set of bits 126. As used herein, a "set of" items means one or more items. In this manner, the set of bits 126 may include one or more bits.

The bit state of the set of bits 126 may be the bit value of each bit in the set of bits 126. The set of bits 126 may have a set of bit states 124 that are possible. Each of the set of bit states 124 may correspond to a phase shift, or particular phase angle. In this manner, the phase applied by the phase shifter 122 may be quantized, or discretized, by the set of bits 126. In this illustrative example, the set of bits 126 may include n-bits. Thus, the phase shifter 122 is referred to as an n-phase shifter. The set of bit states 124 for the set of bits 126 may correspond to a discrete set of phase shifts 127. The phase shifter 122 may be a digital phase shifter selected from one of, for example, but not limited to, a four-bit phase shifter, a five-bit phase shifter, a six-bit phase shifter, a seven-bit phase shifter, an eight-bit phase shifter, or some other type of phase shifter.

The controller 104 is used to control the different phase shifters 118. For example, the controller 104 may send commands to the phase shifter 122 to switch between the set of bit states 124. As depicted, the controller 104 may include a beam manager 130, a bit state selector 132, a bit state evaluator 134, and a command generator 135. Each of the beam manager 130, the bit state selector 132, the bit state evaluator 134, and the command generator 135 may be implemented in hardware, software, or a combination of the two, depending on the implementation.

The beam manager 130 identifies the desired direction 116 in which the beam 113 of the electromagnetic radiation 112 is to be directed. Further, the beam manager 130 identifies a desired phase shift that needs to be applied by each of the phase shifters 118 to steer the beam 113 in the desired direction. The beam manager 130 sends an identification of this desired phase shift to the bit state selector 132. For example, the beam manager 130 may identify a desired phase shift 136 to be applied by a particular phase shifter 122. The beam manager 130 sends this identification to the bit state selector 132.

The bit state selector 132 is configured to identify a candidate bit state 137 from the set of bit states 124 for the phase shifter 122 that may be used to achieve the desired phase shift 136. The candidate bit state 137 may correspond to a particular phase shift in the discrete set of phase shifts 127. However, this phase shift may offset from the desired phase shift 136. This difference may be referred to as a quantization error 138.

Further, in switching from a current bit state 140 to the candidate bit state 137, a bit toggle error 142 may be introduced. This bit toggle error 142 may be caused by the electronic devices and/or components in the phase shifter 122 used to switch between bit states. For example, switching from the current bit state 140 to the candidate bit state 137 may include changing, or toggling, the bit values of two bits in the set of bits 126. Changing each of these two bits may introduce errors that are together referred to as the bit toggle error 142.

Consequently, changing the current bit state 140 to the candidate bit state 137 may result in an actual phase shift 144 being applied by the phase shifter 122 that is different from the desired phase shift 136. This difference between the actual phase shift 144 and the desired phase shift 136 may be referred to as a total error 146. The total error 146 may be a sum of both the quantization error 138 and the bit toggle error 142.

The bit state evaluator 134 is configured to determine whether the total error 146 associated with the phase shifter 122 switching from the current bit state 140 to the candidate bit state 137 is greater than desired. The bit state evaluator 134 may evaluate the total error 146 for the candidate bit state 137, as well as a first total error 148 for a first adjacent bit state 150 and a second total error 152 for a second adjacent bit state 154.

The first adjacent bit state 150 may be the bit state in the set of bit states 124 corresponding to the next highest phase shift, while the second adjacent bit state 154 may be the bit state in the set of bit states 124 corresponding to the next lowest phase shift.

From the group of the candidate bit state 137, the first adjacent bit state 150, and the second adjacent bit state 154, the bit state evaluator 134 may select the bit state having the lowest total error as the new bit state 156 for the phase shifter 122. In this manner, the bit state evaluator 134 selects the bit state having the minimum total error as the new bit state.

The command generator 135 is configured to generate and send a command 158 to the phase shifter 122 to switch from the current bit state 140 to the new bit state 156. The process described above may be performed for each of the phase shifters 118 in the antenna 102.

In this manner, bit toggle errors and quantization errors may be electronically compensated by the controller 104 when electronically steering the antenna 102 using the phase shifters 118.

The illustration of the antenna system 100 in FIG. 1 is not meant to imply physical or architectural limitations to the manner in which an illustrative embodiment may be implemented. Other components in addition to or in place of the ones illustrated may be used. Some components may be optional. Also, the blocks are presented to illustrate some functional components. One or more of these blocks may be combined, divided, or combined and divided into different blocks when implemented in an illustrative embodiment.

With reference now to FIG. 2, an illustration of a table of bit states, expected phase shifts, and actual phase shifts is depicted in accordance with an illustrative embodiment. In this illustrative example, a table 200 includes bit states 202, expected phase shifts 204, and actual phase shifts 206. The values in the table 200 are for a four-bit phase shifter.

The bit states 202 include all of the possible bit states in the set of bit states for a four-bit phase shifter. The expected phase shifts 204 include the phase shifts expected when the phase shifter switches to a particular bit state.

The actual phase shifts 206 include the actual phase shifts that would result if the phase shifter switches to a particular bit state. The difference between an actual phase shift and an expected phase shift for a particular bit state is the bit toggle error.

Figure 3:
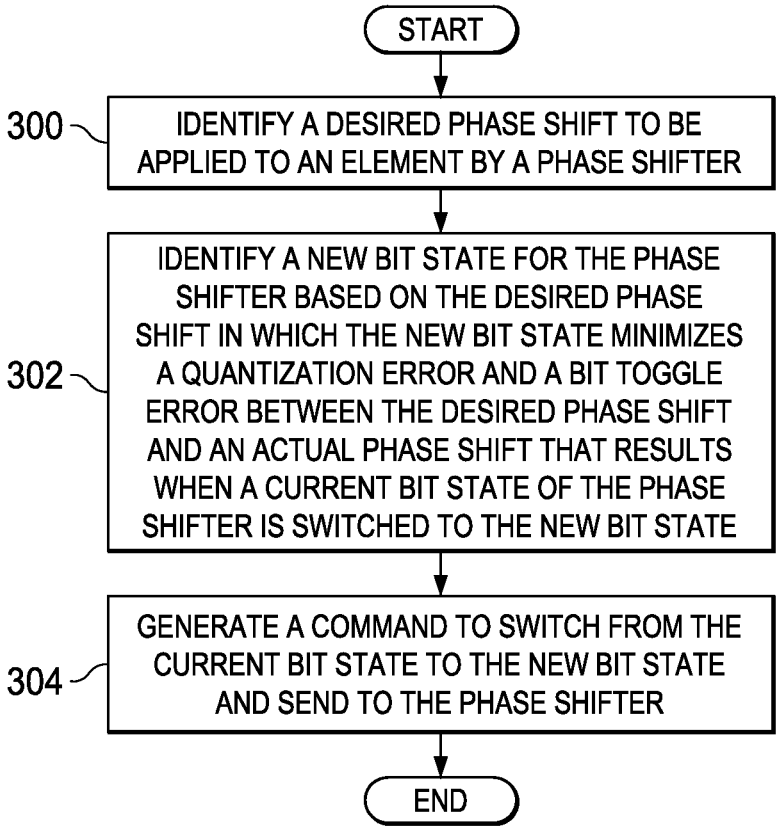
FIG. 3 is an illustration of a process for electronically compensating for errors in a phase shifter in the form of a flowchart in accordance with an illustrative embodiment.

With reference now to FIG. 3, an illustration of a process for electronically compensating for errors in a phase shifter is depicted in the form of a flowchart in accordance with an illustrative embodiment. The process illustrated in FIG. 3 may be implemented using a controller, such as the controller 104 described in FIG. 1.

The process begins by identifying a desired phase shift to be applied to an element by a phase shifter (operation 300). The element may be one element in an array of elements for a phased array antenna. The desired phase shift may be the phase shift needed such that the array of elements may be directed to form a beam in a desired angular direction.

Next, a new bit state for the phase shifter is identified based on the desired phase shift in which the new bit state minimizes a quantization error and a bit toggle error between the desired phase shift and an actual phase shift that results when a current bit state of the phase shifter is switched to the new bit state (operation 302).

Thereafter, a command to switch from the current bit state to the new bit state is generated and sent to the phase shifter (operation 304), with the process terminating thereafter. Once the phase shifter switches to the new bit state, the phase shifter may cause the actual phase shift corresponding to this new bit state to be applied to the electrical signals received and generated by the element.

Figure 4:
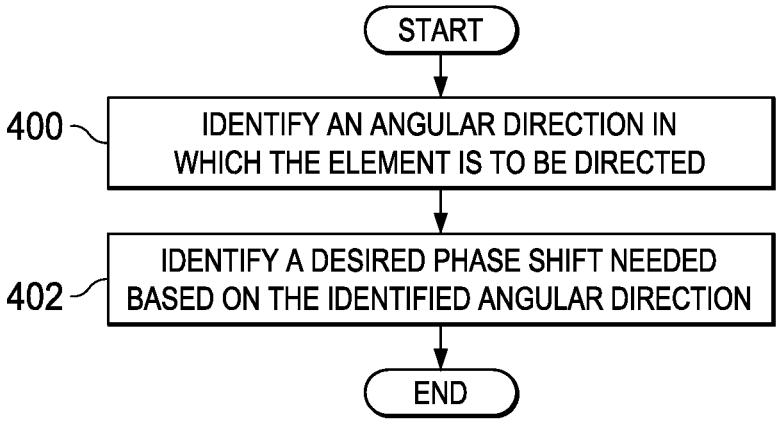
FIG. 4 is an illustration of a process for identifying a desired phase shift to be applied to an element by a phase shifter in the form of a flowchart in accordance with an illustrative embodiment.

With reference now to FIG. 4, an illustration of a process for identifying a desired phase shift to be applied to an element by a phase shifter is depicted in the form of a flowchart in accordance with an illustrative embodiment. The process illustrated in FIG. 4 may be implemented using a controller, such as the controller 104 described in FIG. 1. In particular, the process described in FIG. 4 may be used to implement the operation 302 in FIG. 3.

The process begins by identifying an angular direction in which the element is to be directed (operation 400). This operation 400 may be performed in response to receiving a phase command in spherical coordinates. These spherical coordinates may be (θ,ϕ), where θ is a spherical system elevation angle measured clockwise from the Z-axis and ϕ is a spherical system azimuth angle measured counterclockwise from the X-axis. The X-axis, Y-axis, and Z-axis are for a radar coordinate system in which the phased array antenna sits at the origin of the coordinate system and the surface of the Earth lies in the X-Y plane and in which the Z-axis is perpendicular to the X-Y plane in a direction away from the surface of the Earth.

In the operation 400 described above, identifying the angular direction includes identifying the directional cosines of the phase command as follows:

$$u=\sin\theta\cos\phi \tag{1}$$

$$v=\sin\theta\sin\phi \tag{2}$$

where u and v are the directional cosines, with respect to the X-axis and Y-axis, respectively, of the phase command.

Next, the processes identifies a desired phase shift needed based on the identified angular direction (operation 402), with the process terminating thereafter. In this final operation 402, the desired phase shift may be determined based on the angular direction in which the phased array antenna and/or the element are to be directed, the location of the element, the frequency, and the insertion phase.

The final operation 402 may be performed as follows:

$$\beta_n=\left\{\frac{2\pi}{\lambda}(ux_n+vy_n)+E_n\right\}\mathrm{mod}(2\pi), \tag{3}$$

$$E_n=\text{Compensation-phase} \tag{4}$$

where $$\beta_n=2\pi\left\{\left[\left(\frac{ux_n+vy_n}{\lambda}\right)+\frac{E_n}{2\pi}\right]\mathrm{mod}(1)\right\} \tag{5}$$

$$\beta_n=2\pi\left\{\left[\left(\frac{ux_n+vy_n}{\lambda_0}\right)\frac{\lambda_0}{\lambda}+\frac{E_n}{2\pi}\right]\mathrm{mod}(1)\right\} \tag{6}$$

$$\beta_n=2\pi\left\{\left[\left(u\frac{x_n}{\lambda_0}+v\frac{y_n}{\lambda_0}\right)\frac{f}{f_0}+\frac{E_n}{2\pi}\right]\mathrm{mod}(1)\right\}, \tag{7}$$

where n is the index of the element, $\beta_n$ is the desired phase shift needed for the element, $x_n$ and $y_n$ are the location coordinates of the $n^{th}$ element $$\frac{2\pi}{\lambda}(ux_n+vy_n)$$

is the desired phase-shift associated with the direction given by (u,v), mod(2π) indicates that the phase shift is modular with respect to 2π and means converting the value to a new value between 0 and 2π, mod(1) indicates modular with respect to 1 and means converting the value to a new value between 0 and 1, $E_n$ is the path compensation phase shift associated with the $n^{th}$ element, λ is wavelength, $\lambda_0$ is the wavelength at the center frequency, f is frequency, and $f_0$ is the center frequency.

Equation 7 may be used to normalize the location of the element within the array of elements. In particular, the location of the element may be normalized with respect to wavelength, $\lambda_0$, at a center frequency, $f_0$.

Figure 5:
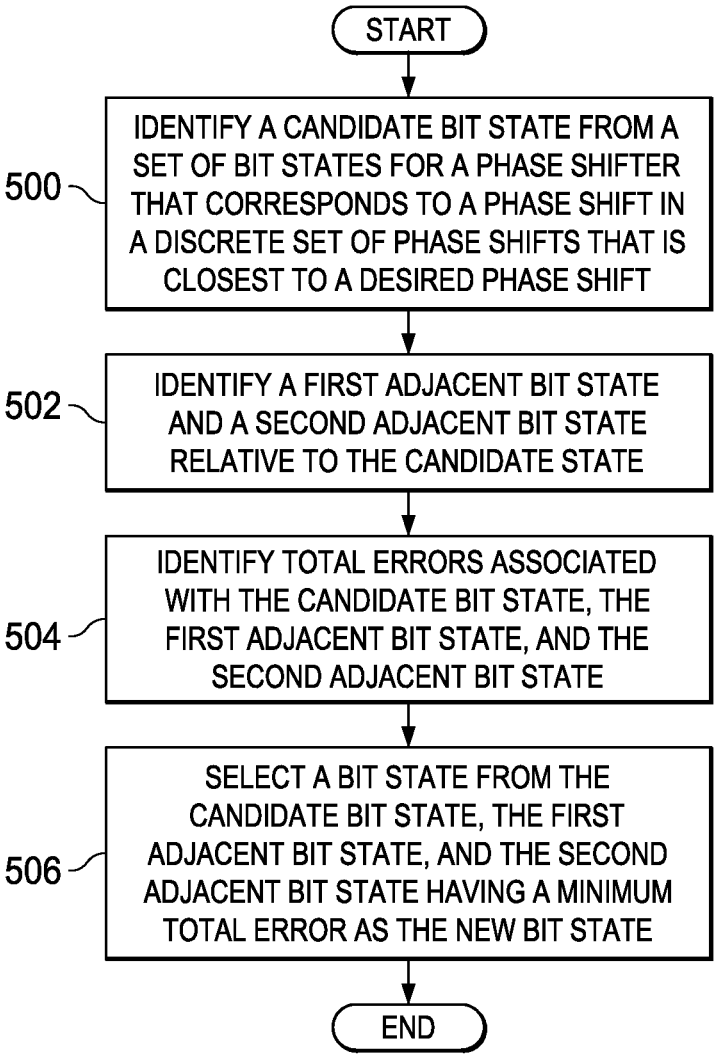
FIG. 5 is an illustration of a process for identifying a new bit state for a phase shifter in the form of a flowchart in accordance with an illustrative embodiment.

With reference now to FIG. 5, an illustration of a process for identifying a new bit state for a phase shifter is depicted in the form of a flowchart in accordance with an illustrative embodiment. The process illustrated in FIG. 5 may be implemented using a controller, such as the controller 104 described in FIG. 1. In particular, the process described in FIG. 5 may be used to implement the operation 302 in FIG. 3.

The process begins by identifying a candidate bit state from a set of bit states for a phase shifter that corresponds to a phase shift in a discrete set of phase shifts that is closest to a desired phase shift (operation 500). In operation 500, the candidate bit state may be identified using the following:

$$\hat{\beta}_n=Q[\beta_n\mathrm{mod}(1)] \tag{8}$$

where Q is the quantization that matches a bit state to a phase shift, and $\hat{\beta}_n$ is the quantized phase shift that matches the bit state.

Next, a first adjacent bit state and a second adjacent bit state relative to the candidate state are identified (operation 502). The first adjacent bit state and the second adjacent bit state may be given as follows:

$$\hat{\beta}_n\pm\frac{1}{2^N}. \tag{9}$$

Thereafter, total errors associated with the candidate bit state, the first adjacent bit state, and the second adjacent bit state are identified (operation 504). The total error associated with the candidate bit state may be as follows:

$$E_n=\beta_n-\hat{\beta}_n+\epsilon_{BT} \tag{10}$$

where $\epsilon_{BT}$ is the total error. The total error includes the quantization error and the bit toggle error. The bit toggle error is as follows:

$$\varepsilon_{BT}=\sum_{i=1}^{N_p}\hat{\varepsilon}(i), \tag{11}$$

where $\epsilon_{BT}$ is the bit toggle error, $N_p$ is the total number of bits for the phase shifter, and i is the index for the particular bit. Further, $\hat{\epsilon}(i)$ is the $i^{th}$ bit toggle error for the particular bit if that bit is toggled. When the particular bit is not toggled, $\hat{\epsilon}(i)$ is equal to 0.

Similarly, the bit toggle error associated with the first adjacent bit state and the second adjacent bit state may be identified as follows:

$$\varepsilon_n^+=\beta_n-\left(\hat{\beta}_n+\frac{1}{2^N}\right)+\varepsilon_{BT}^+,\text{ where} \tag{12}$$

$$\varepsilon_{BT}^+=\sum_{i=1}^{N}\hat{\varepsilon}(i), \tag{13}$$

where $\epsilon_n^+$ is the total error for the first adjacent bit state and $$\varepsilon_n^- = \beta_n - \left(\hat{\beta}_n - \frac{1}{2^N}\right) + \varepsilon_{BT}^+, \text{ where} \tag{14}$$

$$\varepsilon_{BT}^- = \sum_{i=1}^{N} \hat{\varepsilon}(i), \tag{15}$$

where $\epsilon_n^-$ is the total error for the second adjacent bit state.

Thereafter, a bit state from the candidate bit state, the first adjacent bit state, and the second adjacent bit state having the minimum total error is selected as the new bit state (operation 506), with the process terminating thereafter. In this operation 506, the new bit state is selected as follows:

$$\min\{|\varepsilon_n|, |\varepsilon_n^+|, |\varepsilon_n^-|\}. \tag{16}$$

In this manner, the new bit state minimizes the quantization error and the bit toggle error may be selected in the operation 506.

Figure 6:
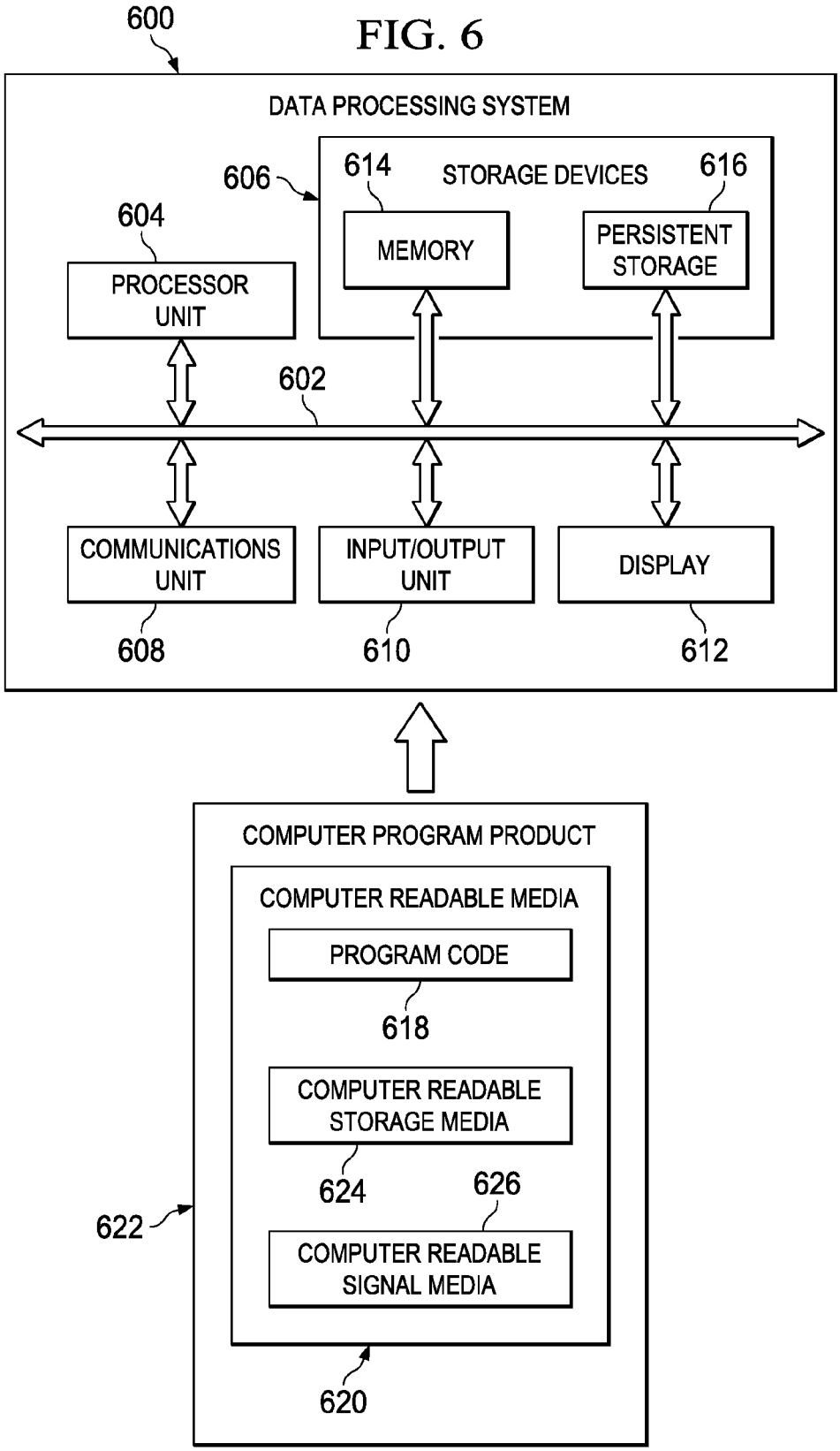
FIG. 6 is an illustration of a data processing system in the form of a block diagram in accordance with an illustrative embodiment.

Turning now to FIG. 6, an illustration of a data processing system in the form of a block diagram is depicted in accordance with an illustrative embodiment. A data processing system 600 may be used to implement one or more computers in the computer system 106 in FIG. 1. As depicted, the data processing system 600 includes a communications framework 602, which provides communications between a processor unit 604, storage devices 606, a communications unit 608, an input/output unit 610, and a display 612. In some cases, the communications framework 602 may be implemented as a bus system.

The processor unit 604 is configured to execute instructions for software to perform a number of operations. The processor unit 604 may comprise a number of processors, a multi-processor core, and/or some other type of processor, depending on the implementation. In some cases, the processor unit 604 may take the form of a hardware unit, such as a circuit system, an application specific integrated circuit (ASIC), a programmable logic device, or some other suitable type of hardware unit.

Instructions for the operating system, applications, and/or programs run by the processor unit 604 may be located in the storage devices 606. The storage devices 606 may be in communication with the processor unit 604 through the communications framework 602. As used herein, a storage device, also referred to as a computer readable storage device, is any piece of hardware capable of storing information on a temporary and/or permanent basis. This information may include, but is not limited to, data, program code, and/or other information.

Memory 614 and persistent storage 616 are examples of the storage devices 606. The memory 614 may take the form of, for example, a random access memory or some type of volatile or non-volatile storage device. The persistent storage 616 may comprise any number of components or devices. For example, the persistent storage 616 may comprise a hard drive, a flash memory, a rewritable optical disk, a rewritable magnetic tape, or some combination of the above. The media used by the persistent storage 616 may or may not be removable.

The communications unit 608 allows the data processing system 600 to communicate with other data processing systems and/or devices. The communications unit 608 may provide communications using physical and/or wireless communications links.

The input/output unit 610 allows input to be received from and output to be sent to other devices connected to the data processing system 600. For example, the input/output unit 610 may allow user input to be received through a keyboard, a mouse, and/or some other type of input device. As another example, the input/output unit 610 may allow output to be sent to a printer connected to the data processing system 600.

The display 612 is configured to display information to a user. The display 612 may comprise, for example, without limitation, a monitor, a touch screen, a laser display, a holographic display, a virtual display device, and/or some other type of display device.

In this illustrative example, the processes of the different illustrative embodiments may be performed by the processor unit 604 using computer-implemented instructions. These instructions may be referred to as program code, computer usable program code, or computer readable program code and may be read and executed by one or more processors in the processor unit 604.

In these examples, program code 618 is located in a functional form on a computer readable media 620, which is selectively removable, and may be loaded onto or transferred to the data processing system 600 for execution by the processor unit 604. The program code 618 and the computer readable media 620 together form a computer program product 622. In this illustrative example, the computer readable media 620 may be a computer readable storage media 624 or a computer readable signal media 626.

The computer readable storage media 624 is a physical or tangible storage device used to store the program code 618 rather than a medium that propagates or transmits the program code 618. The computer readable storage media 624 may be, for example, without limitation, an optical or magnetic disk or a persistent storage device that is connected to the data processing system 600.

Alternatively, the program code 618 may be transferred to the data processing system 600 using the computer readable signal media 626. The computer readable signal media 626 may be, for example, a propagated data signal containing the program code 618. This data signal may be an electromagnetic signal, an optical signal, and/or some other type of signal that can be transmitted over physical and/or wireless communications links.

The illustration of the data processing system 600 in FIG. 6 is not meant to provide architectural limitations to the manner in which the illustrative embodiments may be implemented. The different illustrative embodiments may be implemented in a data processing system that includes components in addition to or in place of those illustrated for data processing system 600. Further, components shown in FIG. 6 may be varied from the illustrative examples shown.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent a module, a segment, a function, and/or a portion of an operation or step.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a phase shifter configured to provide a phase shift to an element of an array of antenna elements by switching between a set of bit states that correspond to a discrete set of phase shifts, the set of bit states including a current bit state, the set of bit states being for a set of bits generated for the phase shifter; and a controller configured to identify a new bit state for the phase shifter, relative to the current bit state, based on a desired phase shift for the element, wherein the desired phase shift comprises a specified phase shift that is to be applied by the phase shifter to steer a beam from the element in a direction, wherein the new bit state minimizes a quantization error and a bit toggle error between the desired phase shift for the element and an actual phase shift that results when the current bit state is switched to the new bit state.

2. The apparatus of claim 1 further comprising:

wherein a bit value of at least one bit in the set of bits is toggled between a 0 and a 1 to change a bit state for the phase shifter.

3. The apparatus of claim 2, wherein the bit toggle error is introduced when at least one bit in the set of bits is toggled to change the current bit state to the new bit state.

4. The apparatus of claim 1, wherein the quantization error is a difference between the desired phase shift for the element and a particular phase shift in the discrete set of phase shifts that is closest to the desired phase shift.

5. The apparatus of claim 1, wherein the controller comprises:

a bit state selector configured to identify a candidate bit state from the set of bit states that corresponds to a particular phase shift in the discrete set of phase shifts that is closest to the desired phase shift.

6. The apparatus of claim 5, wherein the controller further comprises:

a bit state evaluator configured to identify a total error for each of the candidate bit state, a first adjacent bit state, and a second adjacent bit state in which the total error includes the quantization error and the bit toggle error.

7. The apparatus of claim 6, wherein the bit state evaluator is configured to select a bit state from the candidate bit state, the first adjacent bit state, and the second adjacent bit state associated with a minimum total error as the new bit state.

8. The apparatus of claim 1, wherein the controller comprises:

a command generator configured to generate and send a command to the phase shifter to change the current bit state to the new bit state.

9. The apparatus of claim 1, wherein the element is one element in an array of elements for a phased array antenna.

10. The apparatus of claim 9, wherein the controller comprises:

a beam manager configured to identify the desired phase shift for the element needed to direct a beam formed by the phased array antenna in a desired direction based on at least one of the desired direction in which the beam is to be directed, a location of the element within the array of elements, a frequency, or an insertion phase.

11. The apparatus of claim 1, wherein the phase shifter is a digital phase shifter selected from one of a four-bit phase shifter, a five-bit phase shifter, a six-bit phase shifter, a seven-bit phase shifter, or an eight-bit phase shifter.

12. An antenna system comprising:

an array of elements;

a plurality of phase shifters associated with the array of elements in which a phase shifter in the plurality of phase shifters is configured to apply a phase shift to an element in the array of elements by switching between a set of bit states that correspond to a discrete set of phase shifts, the set of bit states including a current bit state, the set of bit states being for a set of bits generated for the phase shifter; and a controller configured to identify a new bit state for the phase shifter, relative to the current bit state based on a desired phase shift for the element, wherein the desired phase shift comprises a specified phase shift that is to be applied by the phase shifter to steer a beam from the element in a direction, and command the phase shifter to switch from a current bit state to the new bit state, wherein the new bit state minimizes a quantization error and a bit toggle error between the desired phase shift for the element and an actual phase shift that results when the current bit state is switched to the new bit state.

13. The antenna system of claim 12, wherein the controller comprises:

a bit state selector configured to identify a candidate bit state from the set of bit states that corresponds to a particular phase shift in the discrete set of phase shifts that is closest to the desired phase shift.

14. The antenna system of claim 13, wherein the controller further comprises:

a bit state evaluator configured to identify a total error for each of the candidate bit state, a first adjacent bit state, and a second adjacent bit state in which the total error includes the quantization error and the bit toggle error.

15. The antenna system of claim 14, wherein the bit state evaluator is configured to select a bit state from the candidate bit state, the first adjacent bit state, and the second adjacent bit state associated with a minimum total error as the new bit state.

16. A method comprising:

receiving, at a processor, a set of bit states for a phase shifter for an element of an array of antenna elements, the set of bit states including a current bit state;

identifying a new bit state for a phase shifter, relative to the current bit state, associated with an element based on a desired phase shift for the element, wherein the desired phase shift comprises a specified phase shift that is to be applied by the phase shifter to steer a beam from the element in a direction, wherein the new bit state minimizes a quantization error and a bit toggle error between the desired phase shift for the element and an actual phase shift that results when a current bit state is switched to the new bit state; and sending a command to the phase shifter to switch from the current bit state to the new bit state.

17. The method of claim 16, wherein identifying the new bit state comprises:

identifying a candidate bit state from a set of bit states that corresponds to a particular phase shift in a discrete set of phase shifts that is closest to the desired phase shift.

18. The method of claim 16, wherein identifying the new bit state further comprises:

determining whether a candidate bit state, a first adjacent bit state, or a second adjacent bit state minimizes the quantization error and the bit toggle error; and identifying the new bit state as one of the candidate bit state, the first adjacent bit state, and the second adjacent bit state.

19. The method of claim 16 further comprising:

identifying the desired phase shift for the element needed to direct a beam formed by a phased array antenna in a desired direction.

20. The method of claim 19, wherein identifying the desired phase shift comprises:

identifying the desired phase shift based on at least one of the desired direction in which the beam is to be directed, a location of the element within an array of elements, a frequency, or an insertion phase.

* * * * *